US011831098B2

(12) United States Patent
Demaratos et al.

(10) Patent No.: US 11,831,098 B2
(45) **Date of Patent: *Nov. 28, 2023**

(54) METHOD FOR IMPROVING CLEARANCE AND CREEPAGE IN A HIGH VOLTAGE CONNECTOR ASSEMBLY USING A MALE OR FEMALE TERMINAL POSITION ASSURANCE (TPA) DEVICE

(71) Applicant: J.S.T. CORPORATION, Farmington Hills, MI (US)

(72) Inventors: David Demaratos, Wixom, MI (US); Franklin A. Holub, West Bloomfield, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 658 days.

This patent is subject to a terminal disclaimer.

(21) Appl. No.: 16/964,826

(22) PCT Filed: Apr. 25, 2020

(86) PCT No.: PCT/US2020/029977

§ 371 (c)(1),
(2) Date: Jul. 24, 2020

(87) PCT Pub. No.: WO2020/176910

PCT Pub. Date: Sep. 3, 2020

(65) Prior Publication Data

US 2023/0155312 A1 May 18, 2023

Related U.S. Application Data

(60) Provisional application No. 63/014,576, filed on Apr. 23, 2020, provisional application No. 62/810,179, filed on Feb. 25, 2019.

(51) Int. Cl.
*H01R 13/436* (2006.01)

(52) U.S. Cl.
CPC ..... *H01R 13/4365* (2013.01)

(58) Field of Classification Search
CPC ..... H01R 13/4365; H01R 13/436
(Continued)

(56) References Cited

U.S. PATENT DOCUMENTS 4,904,206 A 2/1990 Laudig
4,946,399 A 8/1990 Kawashima
(Continued)

FOREIGN PATENT DOCUMENTS

DE 102014108283 A1 12/2015
WO 2018/215026 A1 11/2018

OTHER PUBLICATIONS

International Search Report of the International Searching Authority for International Application No. PCT/US2019/029536 dated Jul. 10, 2019 (2 sheets).
(Continued)

*Primary Examiner* — Gary F Paumen
(74) *Attorney, Agent, or Firm* — Kratz, Quintos & Hanson, LLP

(57) ABSTRACT

A method for improving clearance and creepage in a male or female high voltage connector assembly using a male terminal position assurance (TPA) device. The high voltage connector assembly is suitable for high voltage electrical terminals. The method includes the steps of allowing a clearance and creepage or electrical path to extend from at least a high voltage electrical terminal to a conductive male outer housing, and or between another terminal using a male or a female TPA device. The TPA device is inserted in the high voltage connector assembly, whereby a clearance and creepage or electrical path extends from the high voltage electrical terminal along at least a surface of the TPA device and to the male outer housing of the high voltage connector
(Continued)

assembly or from the high voltage electrical terminal to another high voltage electrical terminal in using the male and or female TPA device.

14 Claims, 29 Drawing Sheets

(58) Field of Classification Search
USPC ..... 439/595
See application file for complete search history.

(56) References Cited

U.S. PATENT DOCUMENTS

| | | | | |
|---|---|---|---|---|
| 4,984,998 | A | 1/1991 | Duncan | |
| 5,219,300 | A | 6/1993 | Yagi | |
| 5,281,168 | A | 1/1994 | Krehbiel | |
| 5,516,308 | A | 5/1996 | Yamanashi | |
| 5,518,334 | A | 5/1996 | Yagi | |
| 5,595,509 | A | 1/1997 | Fry | |
| 5,738,543 | A | 4/1998 | Rollins | |
| 5,890,935 | A | 4/1999 | Pill | |
| 5,967,842 | A | 10/1999 | Okabe | |
| 5,967,859 | A | 10/1999 | Cecil | |
| 6,004,158 | A | 12/1999 | Ward | |
| 6,024,591 | A | 2/2000 | Foster | |
| 6,155,888 | A | 12/2000 | Kurimoto | |
| 6,183,314 | B1 | 2/2001 | Wada | |
| 6,358,102 | B1 | 3/2002 | Fukamachi | |
| 6,491,542 | B1 | 12/2002 | Zerebilov | |
| 6,655,998 | B1 | 12/2003 | Kurimoto | |
| 10,153,586 | B1 | 12/2018 | Schroll | |
| 10,892,579 | B2 * | 1/2021 | Demaratos | H01R 13/436 |
| 10,923,847 | B2 * | 2/2021 | Demaratos | H01R 13/639 |
| 11,133,619 | B2 * | 9/2021 | Demaratos | H01R 13/629 |
| 11,245,218 | B2 * | 2/2022 | Demaratos | H01R 43/20 |
| 2003/0096539 | A1 | 5/2003 | Ichio | |
| 2007/0093131 | A1 | 4/2007 | Takahashi | |
| 2009/0130903 | A1 | 5/2009 | Hall | |
| 2009/0311896 | A1 | 12/2009 | Myer | |
| 2010/0105254 | A1 | 4/2010 | Park | |
| 2011/0207357 | A1 | 8/2011 | Dick | |
| 2012/0214358 | A1 | 8/2012 | Takahashi | |
| 2013/0023137 | A1 | 1/2013 | Glick | |
| 2016/0013575 | A1 | 1/2016 | Campbell | |
| 2017/0207575 | A1 | 7/2017 | Jabrane | |
| 2017/0207577 | A1 | 7/2017 | Holub | |
| 2018/0261946 | A1 | 9/2018 | Hori | |
| 2018/0316132 | A1 | 11/2018 | Holub | |
| 2019/0173220 | A1 | 6/2019 | Bhat | |

OTHER PUBLICATIONS

Written Opinion of the International Searching Authority for International Application No. PCT/US2019/029536 dated Jul. 10, 2019 (4 sheets).
Office Action of U.S. Appl. No. 16/389,928 dated Dec. 27, 2019.
Related U.S. Appl. No. 16/855,790, filed Apr. 22, 2020.
Related U.S. Appl. No. 16/854,563, filed Apr. 21, 2020.
International Search Report of the International Searching Authority for International Application No. PCT/US2019/029535 dated Jul. 3, 2019 (2 sheets).
Written Opinion of the International Searching Authority for International Application No. PCT/US2019/029535 dated Jul. 3, 2019 (4 sheets).
Office Action of U.S. Appl. No. 16/389,926 dated Oct. 18, 2019.
Office Action of U.S. Appl. No. 16/389,926 dated Mar. 5, 2020.
International Search Report of the International Searching Authority for International Application No. PCT/US2020/029977 dated Jul. 29, 2020 (2 sheets).
Written Opinion of the International Searching Authority for International Application No. PCT/US2020/029977 dated Jul. 29, 2020 (7 sheets).

* cited by examiner

METHOD FOR IMPROVING CLEARANCE AND CREEPAGE IN A HIGH VOLTAGE CONNECTOR ASSEMBLY USING A MALE OR FEMALE TERMINAL POSITION ASSURANCE (TPA) DEVICE

CROSS-REFERENCE TO RELATED APPLICATIONS

This patent application, which claims priority to U.S. Provisional Patent Application having U.S. Ser. No. 62/810,179 filed Feb. 25, 2019, and U.S. Provisional Patent Application U.S. Ser. No. 63/014,576 filed Apr. 23, 2020, the entire contents of which are incorporated herein by reference in their entireties.

BACKGROUND OF THE INVENTION

Due to the high voltage that a high voltage connector assembly is required to meet, and the use of terminal position assurance (TPA) devices within a connector assembly, there exists a desire to improve traditional shielded automotive connectors or housings for use with high voltage terminals, thereby it is desired that clearance and creepage of an electrical path, that of a possible associated shorting current when the connector assembly is in operation or use, from at least a high voltage electrical terminal to another high voltage electrical terminal, element/circuit, and additionally it is desired that clearance and creepage from at least a high voltage electrical terminal to an electrically conducting outer housing, to an electrical element/circuit, or to a traditional stamped metal shield for shielding, is to be improved or increased.

SUMMARY OF THE INVENTION

This invention is directed to a method for improving the path of clearance and creepage of an electrical path in a high voltage connector assembly using a male or female terminal position assurance (TPA) device and housing. The electrical path may be comprised of or associated with a shorting current. The high voltage connector assembly in this invention is highly suitable for high voltage electrical terminals, which are larger terminals. The female TPA device in this invention includes frontward extending members, while the female housing includes a front portion in which terminals reside, and rear portions. The male TPA device in this invention includes wing-like shape members having intermediate members that extend substantially and respectively downward from the wing-like shape members and enter into the male inner housing thereof during use and operation. The male TPA device in this invention also includes a lower member residing between the high voltage electrical terminals when the male TPA device resides in the housing during use and operation. With the above-described characteristics of this invention, "creepage" (a measurement of the shortest path along the surface from any given circuit in a connector to any (usually adjacent) other circuit), and "clearance" (defined as, e.g., a measurement of the shortest electrical path from any exposed electrically conducting element in a given circuit of a connector to any other electrically conducting element in a different circuit in the same connector) are advantageously increased, therefore modifying or influencing the electrical path comprised of or of an associated shorting current when the connector assembly is in operation or use.

DETAILED DESCRIPTION OF THE PREFERRED EMBODIMENTS

Figure 1:
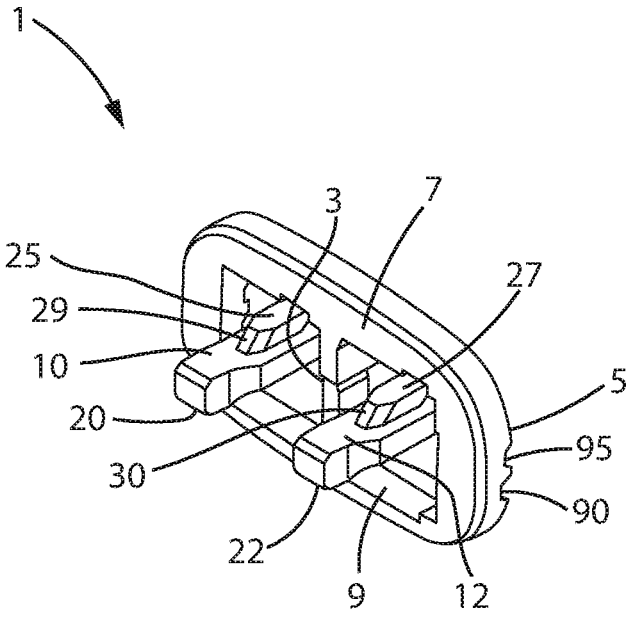
FIG. 1 is a front perspective view of a female terminal position assurance (TPA) device of this invention for use in a female high voltage connector assembly.

FIG. 1 illustrates a front perspective view of the female terminal position (TPA) device, generally referred to as reference numeral 1. The female TPA device 1 includes a middle member 3 and a rounded member 5. The middle member 3 extends from an upper portion 7 to a lower portion 9 of the rounded member 5. The rounded member 5 has, on opposite sides thereof, frontward extending members 10, 12 extending therefrom.

Figure 2:
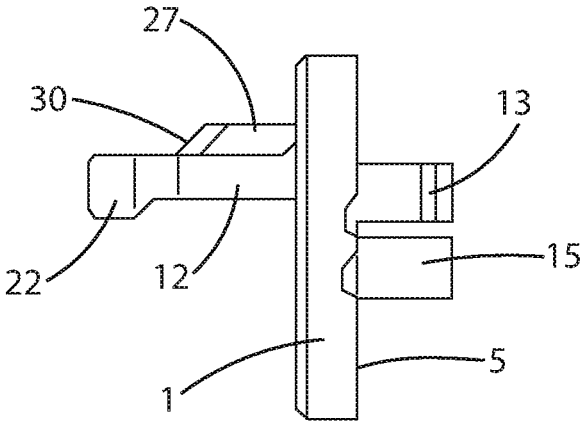
FIG. 2 is a side elevational view of the female TPA device of this invention.

Illustrated in FIG. 2 are an upper backward extending member 13 and a lower backward extending member 15. At a front end of each of the frontward extending members 10, 12 is a corresponding front downward extending member 20, 22. Also each of the frontward extending members 10, 12 has a corresponding upper member 25, 27; and each of the upper members 25, 27 has a corresponding ramp-like front end 29, 30.

Figure 3:
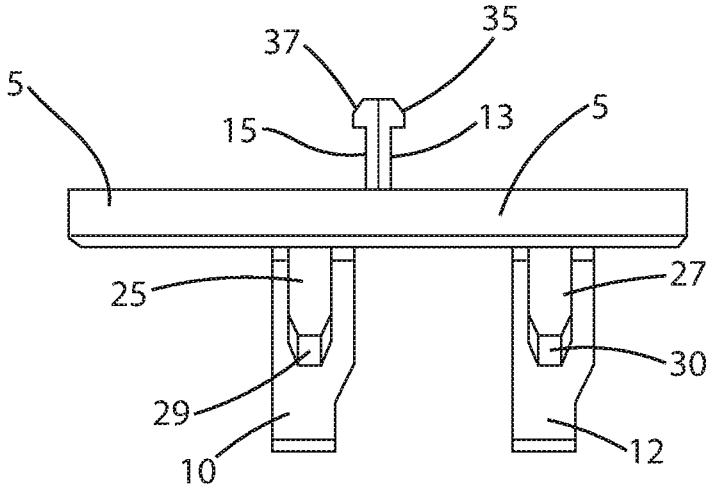
FIG. 3 is a top elevational view of the female TPA device of this invention.
Figure 4:
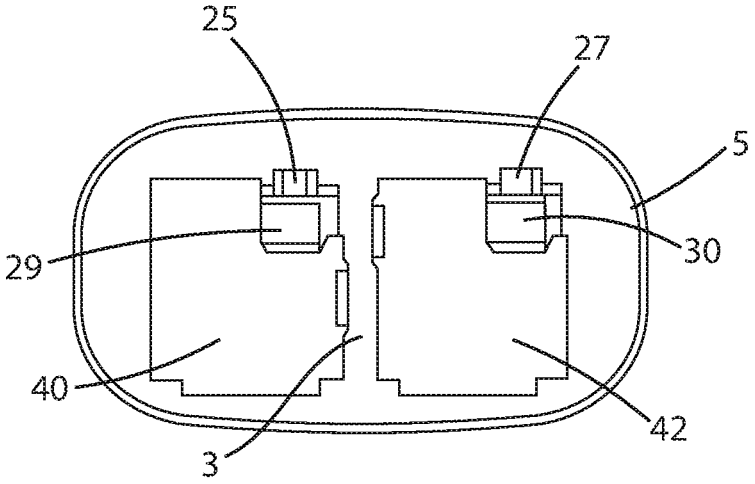
FIG. 4 is a front elevational view of the female TPA device of this invention.

Shown in FIG. 3 is a top elevational view of the female TPA device 1, which illustrates the frontward extending members 10, 12, the corresponding upper members 25, 27 respectively extending therefrom, and the ramp-like front ends 29, 30, respectively, thereof. Also shown are the upper backward extending member 13 and the lower backward extending member 15. The upper backward extending member 13 has an upper barb-like member 35 extending therefrom, while the lower backward extending member 15 has a lower barb-like member 37 extending therefrom. Passing through both sides of the female TPA device 1 are openings 40, 42 with the middle member 3 therebetween, as shown in FIG. 4.

Figure 5:
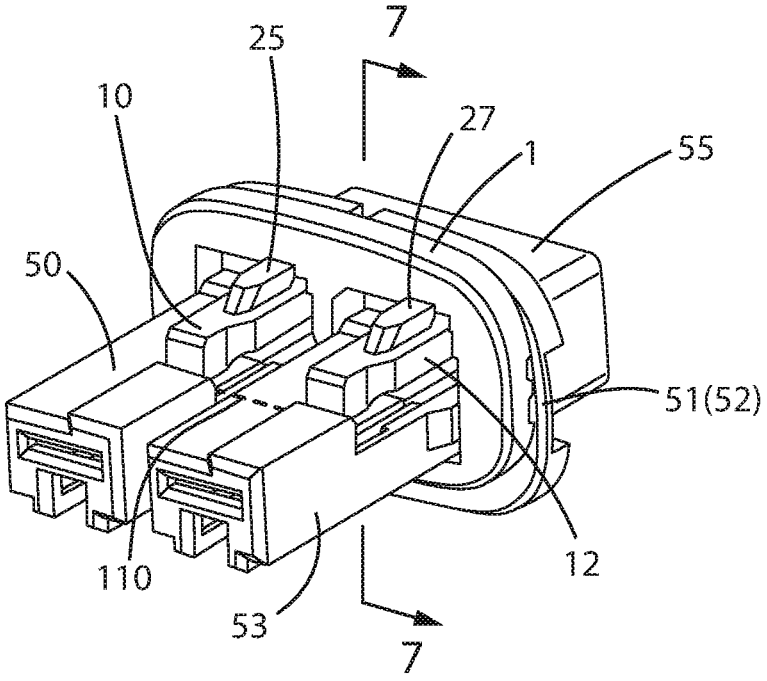
FIG. 5 is a perspective view of the female TPA device of this invention fitted or installed, in a female housing, at a pre-lock position, and further illustrating thereon on the female housing a clearance or creepage for an electrical path from a high voltage electrical terminal to another high voltage electrical terminal.
Figure 6:
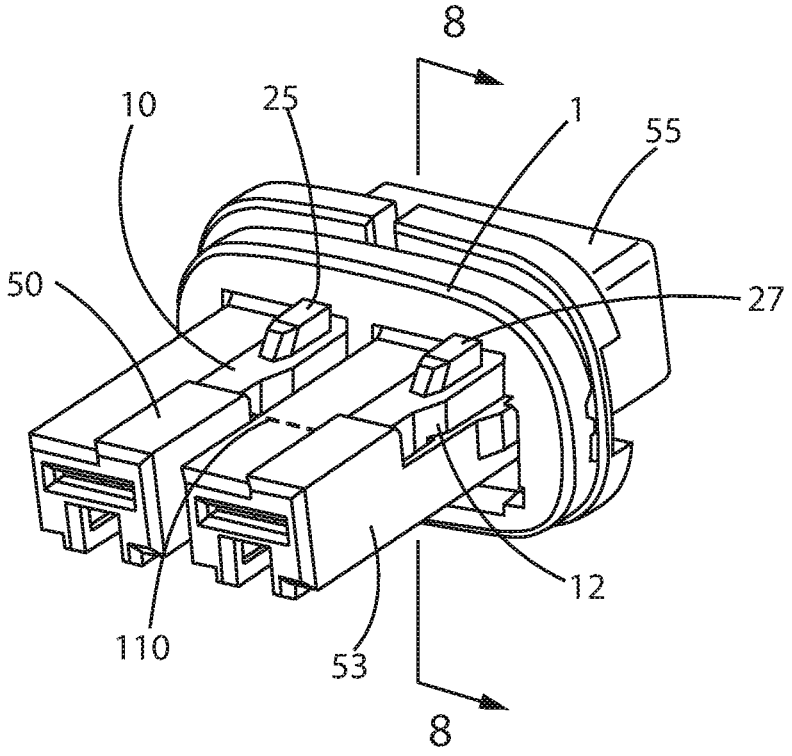
FIG. 6 is a perspective view of the female TPA device of this invention fitted or installed, in a female housing, at a full-lock position, and further illustrating thereon on the female housing the clearance or creepage for the electrical path from the high voltage electrical terminal to another high voltage electrical terminal.

FIG. 5 illustrates the female TPA device in a pre-lock position while inserted into and mounted onto a female housing 50. The female housing 50 has a front portion 53 and a rear portion 55. FIG. 6 illustrates the female TPA device 1 in a full-lock position while inserted into and mounted onto the female housing 50.

This invention is directed to a d for improving clearance and creepage using the female TPA device 1. This invention is also highly suitable for high voltage electrical terminals 60, which are larger terminals. Further illustrated in each of FIGS. 5 and 6, on the female housing 50, and around the female TPA device 1 is a clearance or creepage, for an electrical path 110, from an exposed high voltage electrical terminal 60 extending along and across the top surface of front portion 53 of the female housing 50, and extending toward another exposed high voltage electrical terminal 60 inside the front portion 53.

With the above-described characteristics of this invention, as described above and shown in FIGS. 5 and 6, the "creepage" (a measurement of the shortest electrical path along the surface from any given circuit, here one of a high voltage electrical terminals 60, traveling in a direction or extending along the surface, here the surface of the frontward extending members 10, 12 of the female TPA, device 1 and top surface of front portion 53 of the female housing 50, to any (usually adjacent) other circuit, here another high voltage electrical terminal 60), and the "clearance" (a measurement of the shortest electrical path from any exposed electrically conducting element, here a high voltage electrical terminal 60, in a given circuit of a connector to any other electrically conducting element in a different circuit in the same connector, here another high voltage electrical terminal 60) are advantageously increased, therefore modifying or influencing the electrical path comprised of or of an associated shorting current when the connector assembly is in operation or use. Further, as seen by the dashed line L on FIG. 10, the clearance or creepage for an electrical path 110 may additionally be increased, by an another embodiment of the present invention having the location of the exposed portion of one of the high voltage electrical terminals 60 and the frontward extending member 10 above, as operable on an opposite side end on the front portion 53.

Figure 7:
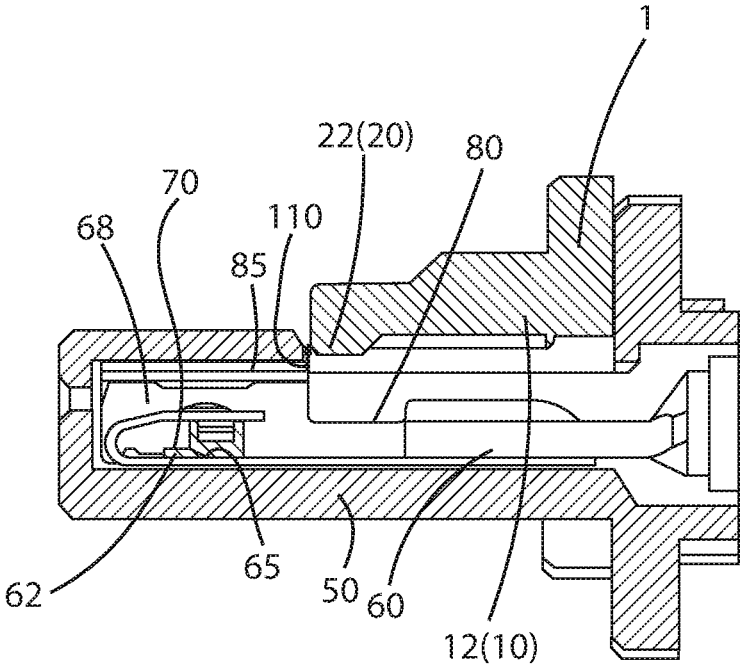
FIG. 7 is a cross-sectional view taken along cross-sectional line 7-7 in FIG. 5 showing a corresponding high voltage terminal with a corresponding front downward extending member of a corresponding frontward extending member of the female TPA device in a pre-lock position inside the female housing, and further illustrating the clearance or creepage for the electrical path extending from the high voltage electrical terminal, as shown in a vertical arrow.

As shown in FIG. 7, a protruding member 62 extends from a lower portion of the female housing 50 The protruding member 62 includes a ramp-like leading end 65. A leading portion 68 of the terminal 60, in turn, has a notch 70 such that when the terminal 60 is fully inserted into the female housing 50, the notch 70 readily passes over the ramp-like leading end 65 of the protruding member 62. Upon the terminal 60 being fully inserted into the female housing 50, the protruding member 62 of the female housing 50 snaps into the notch 70 of the leading end portion 68 of the terminal 60, thereby locking (primary lock) the terminal 60 inside the female housing 50.

FIG. 7 further shows a cross-sectional view taken along line 7-7 in FIG. 5, wherein the female TPA device 1 is at a pre-lock position. As discussed above, the terminal 60 is locked (primary lock) when the protruding member 62 inside the female housing 50 snaps into or enters the notch 70 of the leading end portion 68 of the terminal 60. Consequently, the terminal 60 cannot be pulled out from the female housing 50; and such time, an upper notch 80 of the terminal 60 becomes available for receiving or accommodating therein a corresponding one of the front downward extending members 20, 22. That is, unless the terminal 60 is in the primary lock inside the female housing 50 and the upper notch 80 of the terminal 60 is available to receive or accommodate therein a corresponding one of the front downward extending members 20, 22, the front downward extending members 20, 22 are unable to provide the necessary secondary lock to the terminal 60 inside the female housing 50. In other words, if the terminal 60 is not in the primary lock inside the female housing 50, the female TPA device 1 is prevented, by an upper portion 85 of the leading portion 68 of the terminal 60, from being further pushed downward. Consequently, if the upper portion 85 of the leading portion 68 of the terminal 60 blocks the female TPA device 1 (more particularly, blocks the front downward extending members 20, 22 of the female TPA device 1), the female TPA device 1 is able to detect that it is unable to be further pushed downward, and therefore unable to provide the secondary lock for the terminal 60 inside the female housing 50 (i.e., the female TPA device 1 cannot be further pushed downward to the full-lock position).

Figure 8:
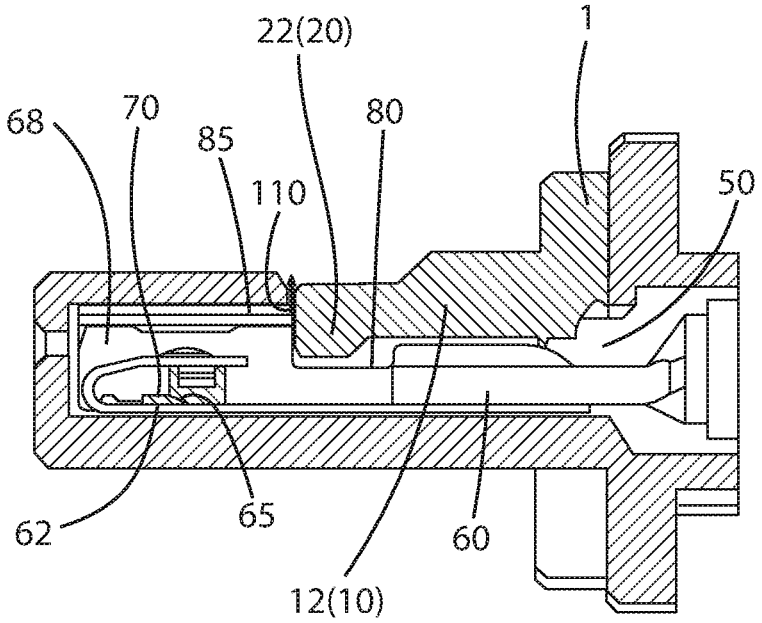
FIG. 8 is a cross-sectional view taken along cross-sectional line 8-8 in FIG. 6 showing the corresponding high voltage terminal with the corresponding front downward extending member of the corresponding frontward extending member of the female TPA device in a full-lock position inside the female housing, and further illustrating the clearance or creepage for the electrical path extending from the high voltage electrical terminal, as shown in a vertical arrow.

FIG. 8 illustrates the female TPA device 1 being in the full-lock position inside the female housing 50. Here, the upper notch 80 of the terminal 60 becomes available for accommodating therein the corresponding one of the front downward extending members 20, 22 of the female TPA device 1; and therefore, when inserted inside a respective one of the upper notches 80 of the terminals 60, the front downward extending members 20, 22 of the female TPA device 1 respectively block the terminals 60 from being pulled out from the inner housing 50, and thus able to provide the secondary lock for the terminals 60 inside the female housing 50.

As further shown in each of FIG. 7 pre-lock female TPA device 1 and FIG. 8 full-lock female TPA device 1, as the female TPA device 1 is oriented on or into the female housing 50, the creepage or clearance for the electrical path 110 (see, arrow) is shown, substantially extending vertically, from the high voltage electrical terminal 60, further along or between a corresponding one of the front downward extending members 20, 22 (of the frontward extending members 10, respectively of the female TPA device 1) and along a vertical and or substantially slanted or angled portion or portions of the front portion 53 of the female housing 50. The front downward extending members 20, 22 are substantially directly behind a portion of the corresponding high voltage electrical terminals 60, respectively.

Figure 9:
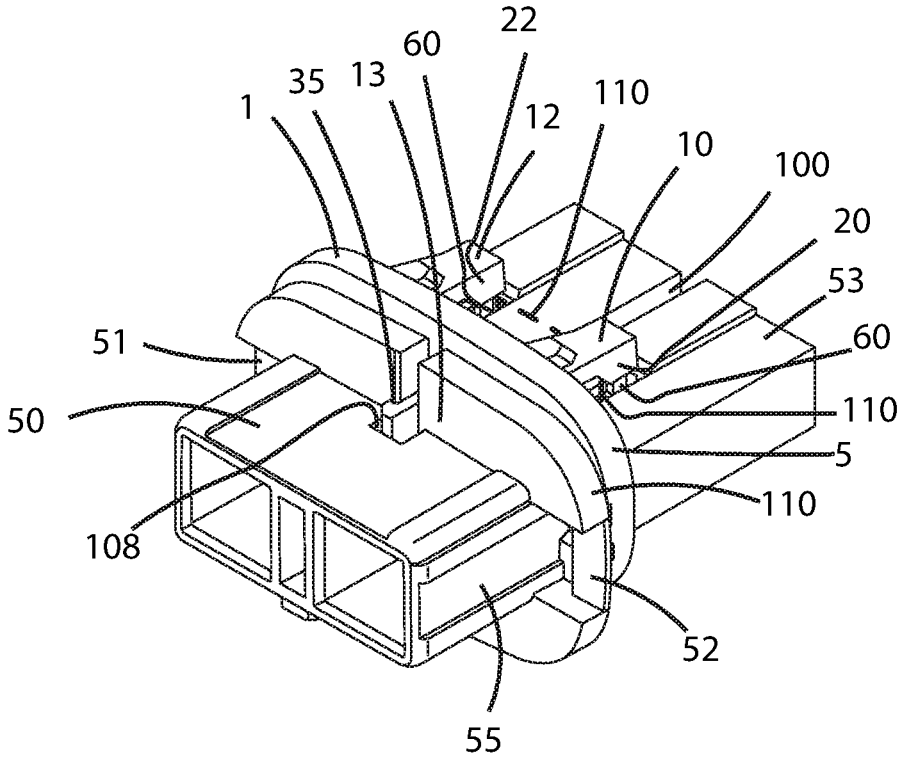
FIG. 9 illustrates the clearance or creepage for the electrical path extending from the high voltage electrical terminal, as shown in a dashed line, and further extending across the female housing and into another high voltage electrical terminal, as shown in the dashed lines, and further extending into another high voltage electrical terminal.
Figure 10:
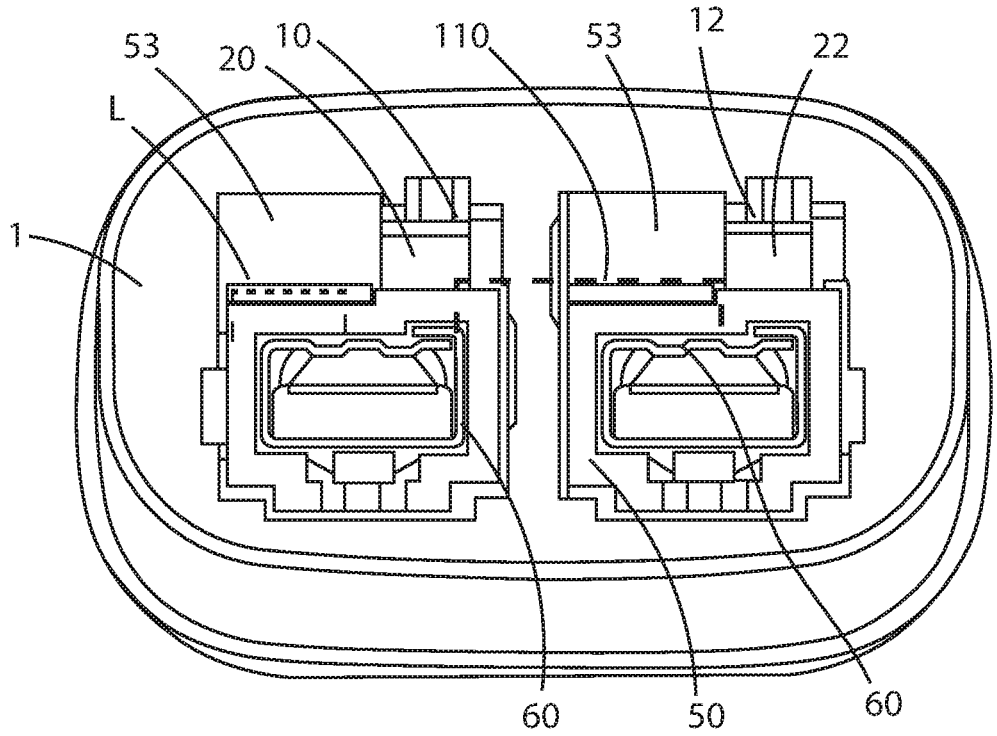
FIG. 10 illustrates a front elevational view of the female housing, showing the clearance or creepage for the electrical path extending from the high voltage electrical terminal, as shown in dashed lines, and further extending across the female housing and into another high voltage electrical terminal, as shown in dashed lines, and further extending into another high voltage electrical terminal.

Illustrated in, for example, FIGS. 9 and 10, the female TPA device 1 is in the pre-lock position in the female housing 50. Shown in FIGS. 9 and 10 are the frontward extending members 10, 12 of the female TPA device 1, above and partially inserted into the front portion 53 of the female housing 50. In FIGS. 9 and 10, the creepage or clearance for the electrical path 110 (see, dashed lines) is shown, substantially extending vertically, from one of the high voltage electrical terminals 60, further exiting partially along or between one of the front downward extending members 20 (of the frontward extending member 10, respectively of the female TPA device 1) and exiting along and from a vertical and or substantially slanted or angled portion or portions of the front portion 53 of the female housing 50, further traveling in a direction or extending along and across the top surface the front portion 53 of the female housing 50 and further substantially extending vertically, into another one of high voltage electrical terminals 60, along or between one of the front downward extending members 22 (of the frontward extending members 12, respectively of the female TPA device 1) and along a vertical and or substantially slanted or angled portion or portions of the front portion 53 of the female housing 50 (see, FIG, 6), the above also having the order vice versa between the terminals 60, and the above also additionally present in a full-lock orientation of the female TPA device 1 with female housing 50 (see, FIGS. 6, 8).

Figure 11:
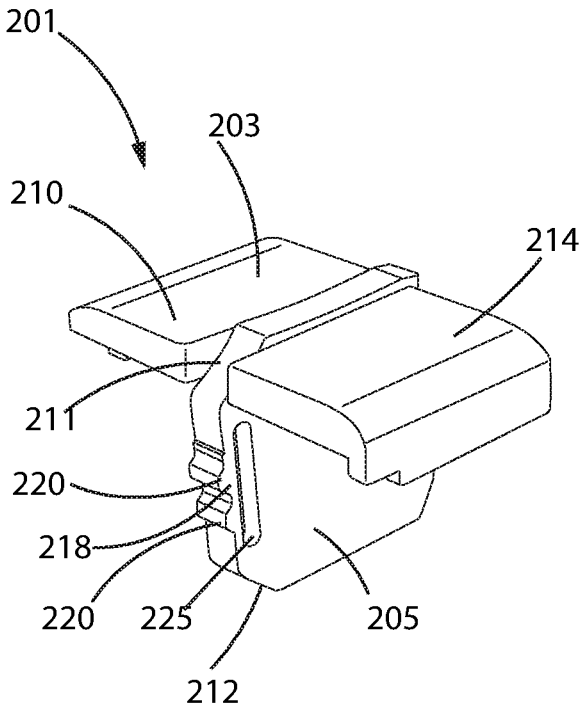
FIG. 11 is a front perspective view of a male terminal position assurance (TPA) device of this invention for use in a male high voltage connector assembly.

FIG. 11 illustrates a front perspective of the male terminal position (TPA) device, generally referred to as reference numeral 201, of this invention. The male TPA device 201 includes an upper member 203 and a lower member 205. The upper member 203 has a substantially wing-like shape having sides 210, 214. The lower member 205 includes a flexible arm member 218 in a front portion thereof.

Figure 12:
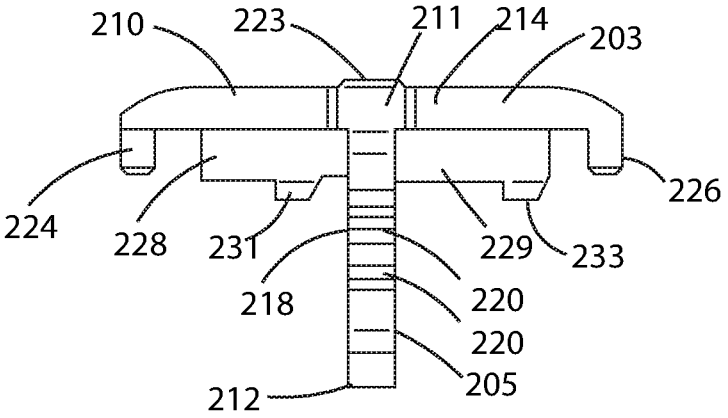
FIG. 12 is a front elevational view of the male TPA device of this invention.

As shown in FIG. 12, the flexible arm member 218 includes at least a protruding member or nub member 220. Although the number of protruding members or nub members 220 shown in FIG. 12 is two, it is not limited thereto. An upper front portion 211 of the flexible arm member 218 is, as shown in FIG. 11, at an incline. Also, a lower front portion 212 of the flexible arm member 218 is, as shown in FIG. 11, at an incline.

Further illustrated in FIG. 12 are end members 224, 226 extending substantially downward from the wing-like shape side members 210, 214, respectively. Also extending substantially downward from the wing-like shape side members 210, 214 are intermediate members 228, 229, respectively. Each intermediate member 228, 229 has a corresponding nub 231, 233, respectively, extending downward therefrom.

Figure 13A:
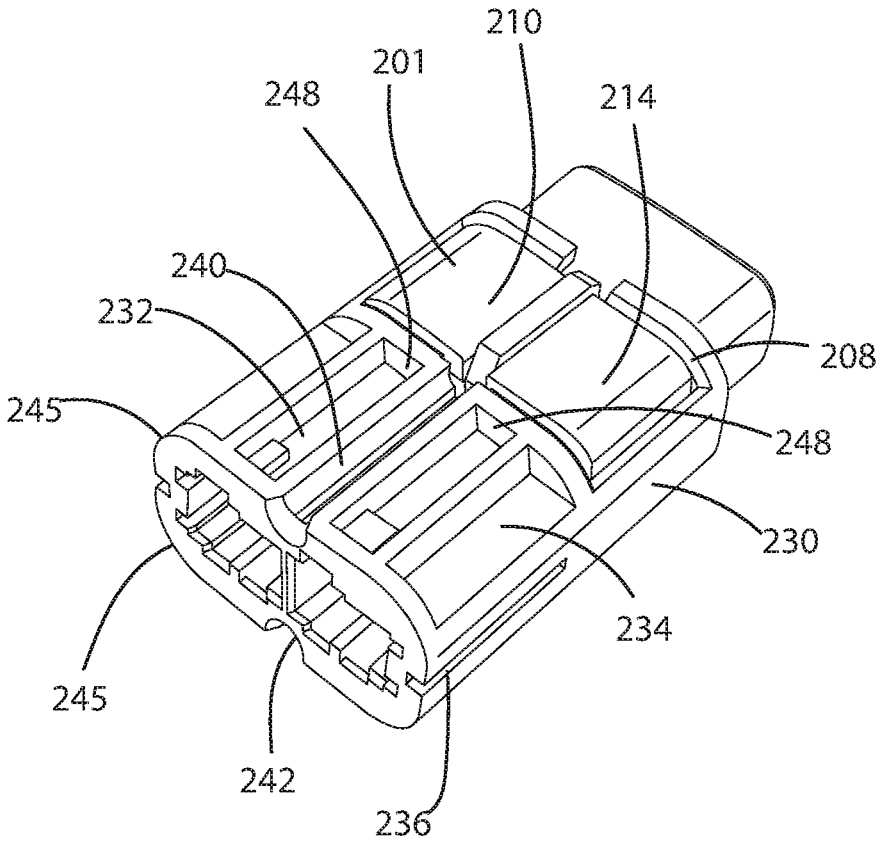
FIG. 13A is a perspective view of the male TPA device of this invention fitted or installed, in a male inner housing, at a pre-lock position.
Figure 13B:
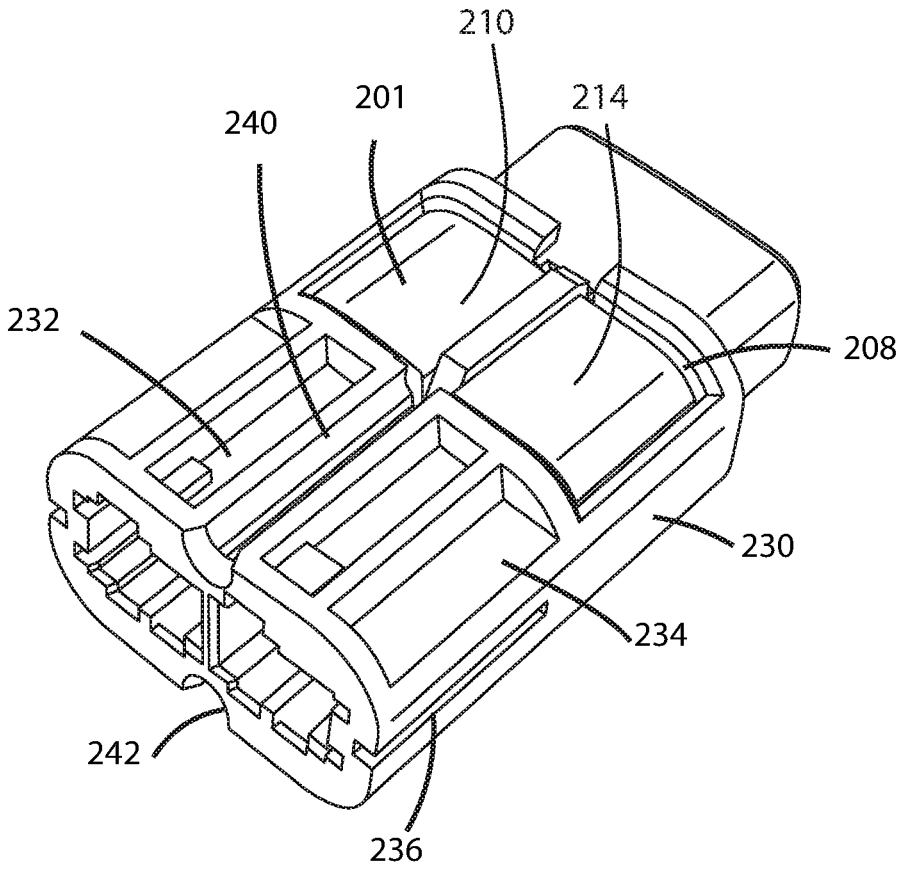
FIG. 13B is a perspective view of the male TPA device of this invention fitted or installed, in a male inner housing, at a full-lock position.
Figure 17:
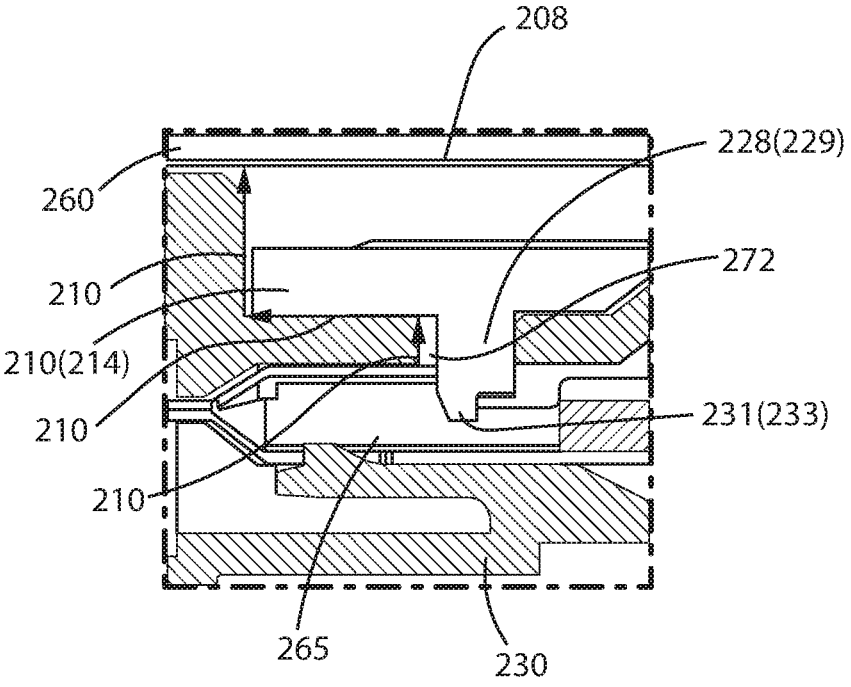
FIG. 17 is a cross-sectional view of a portion of the high voltage connector assembly having the high voltage electrical terminal inserted therein and the male TPA device of this invention within the TPA window and illustrating therein a clearance or creepage for the electrical path substantially along a surface of the male TPA device of this invention.
Figure 18:
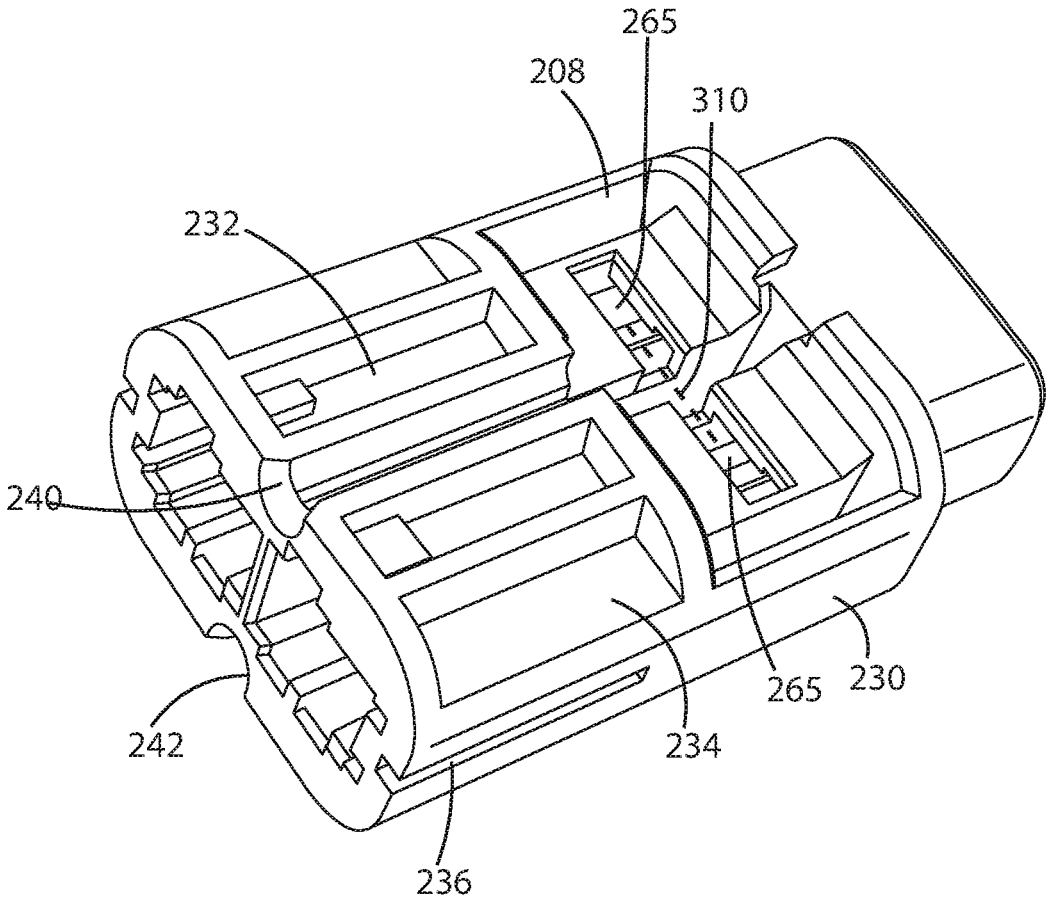
FIG. 18 is a perspective view is a perspective view of the male inner housing of the present invention with high voltage electrical terminals therewithin.
Figure 21A:
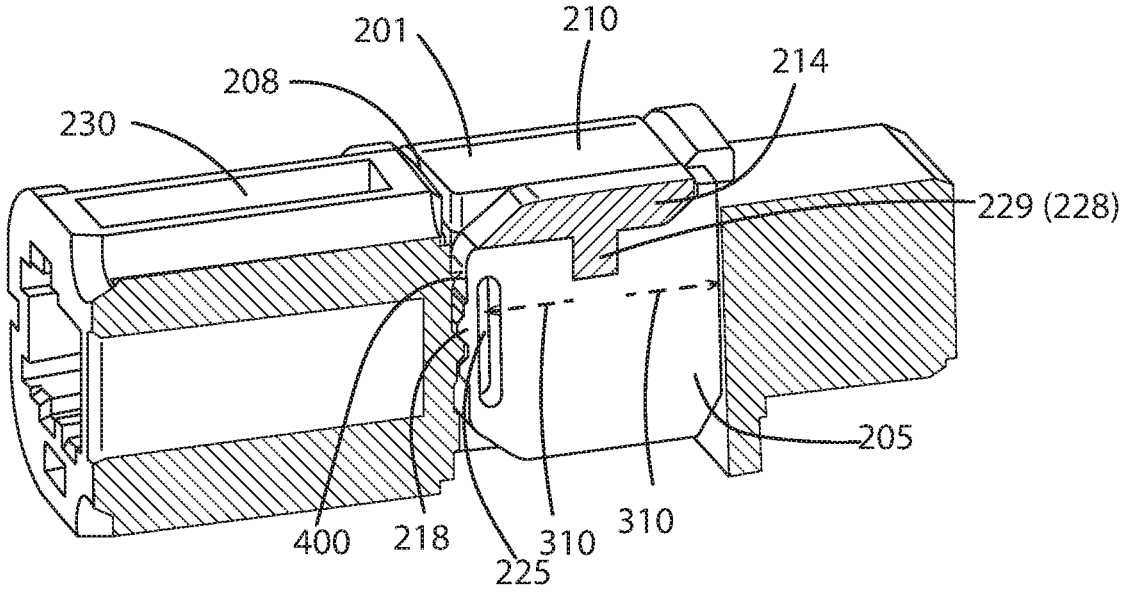
FIG. 21A is a cross-sectional view of a portion of the high voltage connector assembly having the high voltage electrical terminal inserted therein and the male TPA device of this invention within in a pre-lock position and illustrating therein a clearance or creepage for the electrical path substantially along a surface of the male TPA device of this invention.
Figure 21B:
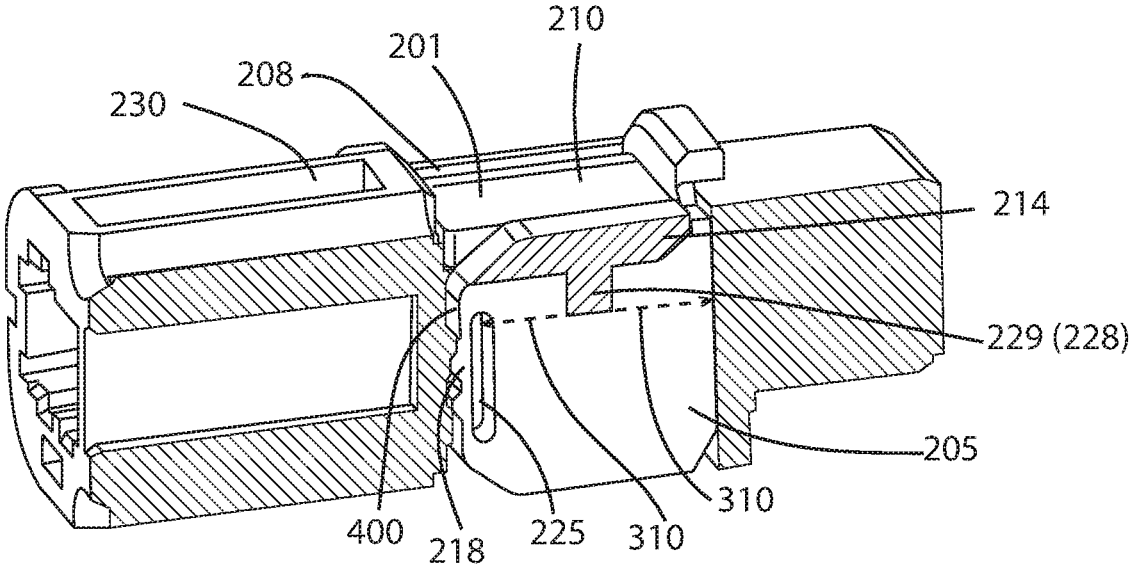
FIG. 21B is a cross-sectional view of a portion of the high voltage connector assembly having the high voltage electrical terminal inserted therein and the male TPA device of this invention within in a full-lock position and illustrating therein a clearance or creepage for the electrical path substantially along a surface of the male TPA device of this invention.

The male TPA device 1 of this invention is shown, in FIG. 13A as being in a pre-lock position, and in FIG. 13B as being in a full-lock position, the male TPA device 201 being inserted through an opening 208 passing through an upper portion of a male inner housing 230 of a high voltage connector assembly (generally referred to as reference number 200, in FIGS. 14 and 16), and fitted or installed, in the male inner housing 230, in a lower opening 400 (see, FIGS. 18, 21A, 21B). Also shown in FIG. 13A, 13B are fitting grooves 232, 234, 236 on the external surfaces of the inner male housing 230 for allowing the male TPA device 201 to be installed or inserted into a male outer housing 260 (see, FIGS. 14-17) of the high voltage connector assembly 200.

Figure 14:
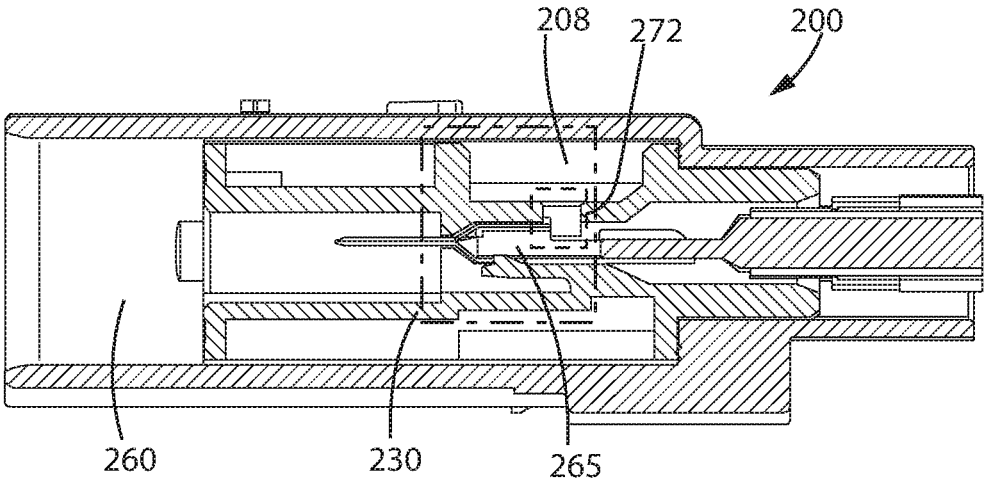
FIG. 14 is a cross-sectional view of a high voltage connector assembly having a high voltage electrical terminal inserted therein and capable of receiving the male TPA device of this invention within a TPA window, as shown in the dashed-lines isolated squared portion.

FIG. 14 is a cross-sectional view of a high voltage connector assembly having the male inner housing 230 with a male TPA device 201 in a pre-lock position or orientation. FIG. 14 further illustrates the male inner housing 230 and male TPA device 201 in a male outer housing 260. The high voltage connector assembly 200 has a high voltage electrical terminal 265 inserted therein and capable of receiving the male TPA device 201 of this invention within a TPA window 272, as shown in the dashed-lines isolated squared portion.

Figure 15:
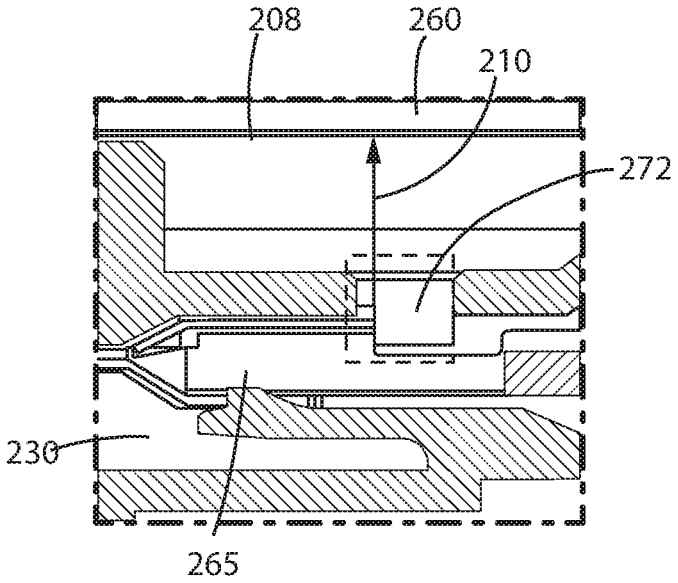
FIG. 15 is a cross-sectional view of a portion of the high voltage connector assembly, having the high voltage electrical terminal inserted therein, capable of receiving the male TPA device of this invention within the TPA window and illustrating therein a clearance for the electrical path from the high voltage electrical terminal to a male outer housing, as shown in a vertical arrow.

FIG. 15 is a cross-sectional view of a portion of the high voltage connector assembly 200, having the high voltage electrical terminal 265 inserted therein, capable of receiving the male TPA device 201 of this invention within the TPA window 272 and illustrating therein a clearance for an electrical path 210 from at least the high voltage electrical terminal 265 to the male inner housing 230 of the high voltage connector assembly 200 through the opening 208 passing through the upper portion of the male inner housing 230, and to the male outer housing 260, as shown in a vertical arrow in FIG. 15.

This invention is directed to a method for improving clearance and creepage in a high voltage connector assembly 200 using the male TPA device 201. The high voltage connector assembly 200 is highly suitable for the high voltage electrical terminals 265, which are larger terminals. The male TPA device 201 in this invention includes the wing-like shape side members 210, 214 with intermediate members 228, 229 substantially downward from the wing-like shape side members 210, 214, respectively. Each intermediate member 228, 229 has a corresponding nub 231, 233, respectively, extending downward therefrom.

With the above-described characteristics of this invention, "creepage" (a measurement of the shortest path along the surface from a circuit, here the high voltage electrical terminal 265, traveling in a direction or extending along the surface, here the surface of male TPA device 201 and male inner housing 230, to any (usually adjacent) other circuit, here an electrically conducting male outer housing 260 or a traditional stamped metal shield (not shown)), and "clearance" (a measurement of the shortest electrical path from any exposed electrically conducting element, here the high voltage electrical terminal 265, in a given circuit of a connector to any other electrically conducting element in a different circuit in the same connector, here the male outer housing 260 or a traditional stamped metal shield (not shown)) are advantageously increased, therefore modifying or influencing the electrical path comprised of or of an associated shorting current when the connector assembly is in operation or use.

Figure 16:
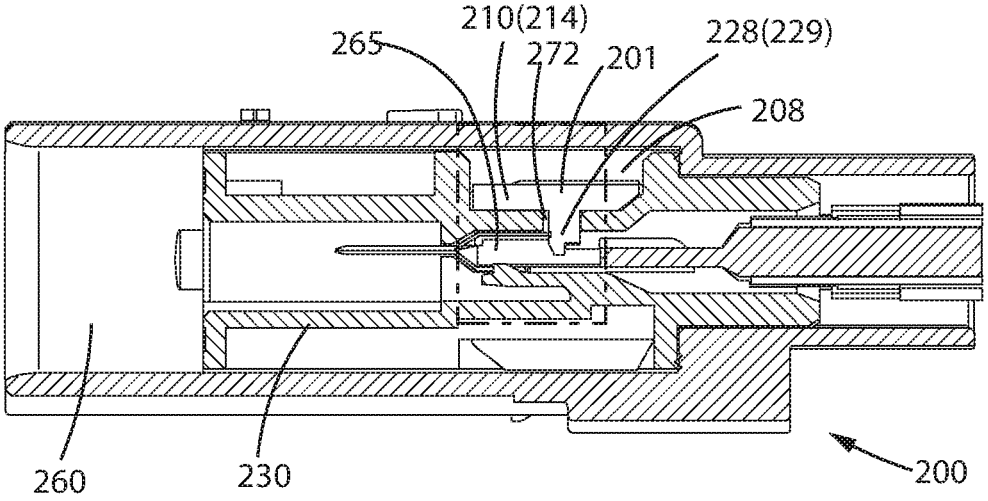
FIG. 16 is cross-sectional view of the high voltage connector assembly having the high voltage electrical terminal inserted therein and the male TPA device of this invention within the TPA window, the male TPA device being in a full-lock position.

More particularly, FIG. 16 is a cross-sectional view of the high voltage connector assembly 200 of this invention having the high voltage electrical terminal 265 inserted into the male inner housing 230, and the male TPA device 201 of this invention inserted therein in a full-lock position or orientation. The corresponding wing-like shape side members 210, 214 residing in the opening 208 (see also, FIG. 13B), and the intermediate members 228, 229 thereof residing in the TPA window 272. As illustrated in FIG. 16, the intermediate member 228 is located substantially directly behind a portion of the high voltage electrical terminal 265.

FIG. 17 is a cross-sectional view of a portion of the high voltage connector assembly 200 having the high voltage electrical terminal 265 inserted therein, as well as the male IPA device 201 of this invention. The intermediate members 228, 229 reside in the TPA window 272 and substantially directly behind a portion of the high voltage electrical terminal 265, illustrating therein the clearance and or creepage for the electrical path 210 from at least the high voltage electrical terminal 265, substantially along an outer surface of the male TPA device 201 of this invention, traveling to the male outer housing 260. As illustrated in FIG. 17, the clearance and or creepage for the electrical path 210 extends, for example, from at least the high voltage electrical terminal 265 along or between the surface or surfaces of at least one of the intermediate members 228, 229 and the surface or surfaces of the male inner housing 230, and further along or between the surface or surfaces of an at least one of the corresponding wing-like shape side members 210, 214, and the surface or surfaces of the male inner housing 230, and yet further along the opening 208 passing through the upper portion of the male inner housing 230 and passing substantially straight, directly to, the male outer housing 260 of the high voltage connector assembly 200.

Further illustrated in FIG. 18, is the male inner housing 230, having a first and second channel 501, 502, respectively. The first and second channels 501, 502 may accommodate therein a respective one of the intermediate members 228, 229 of the male TPA device 201. The first and second channels 501, 502 are each respectively provided with an open portion exiting and extending to the middle channel 400. The first and second middle notches 601, 602 define the open portion and a lower portion of the first and second channels 501, 502, where each of the first and second channels 501, 502 enter into and extend into the middle channel 400, respectively. The respective upper portions of the first and second channels 501, 502 are defined by the opening 208. As discussed later, when the male TPA device 201 resides in a pre-lock position in the male inner housing 230, the lower surface of the intermediate members 228, 229 additionally further define the upper portions of the first and second channels 501, 502 respectively (see, FIG. 19A, 19B).

Further illustrated in FIG. 18, is the male inner housing 230 having the terminals 265 residing therein. Absent or without a male TPA device 201 inserted or residing therein, the male inner housing 230, in operation has a clearance and or creepage for the electrical path 310 from one of the high voltage terminals 265 extending, into a corresponding first and second channels 501, 502 respectively, substantially directly across a top portion of the first and second notches 601, 602, and respectively substantially directly across the middle channel 400 of the male inner housing 230, further toward and into another high voltage terminal 265 as indicated by an electrical path 310.

As will be discussed below, with the TPA of the present invention, the "creepage" (a measurement of the shortest path along the surface from a circuit, here the high voltage electrical terminal 265, traveling in a direction or extending along the surface, here the surface of the lower portion 205 of the male TPA device 201 and the male inner housing 230, to any (usually adjacent) other circuit, here another high voltage electrical terminal 265, and "clearance" (a measurement of the shortest electrical path from any exposed electrically conducting element, here the high voltage electrical terminal 265, in a given circuit of a connector to any other electrically conducting element in a different circuit in the same connector, here another high voltage electrical terminal 265) are advantageously increased, therefore modifying or influencing the electrical path comprised of or of an associated shorting current when the connector assembly is in operation or use.

Figure 19A:
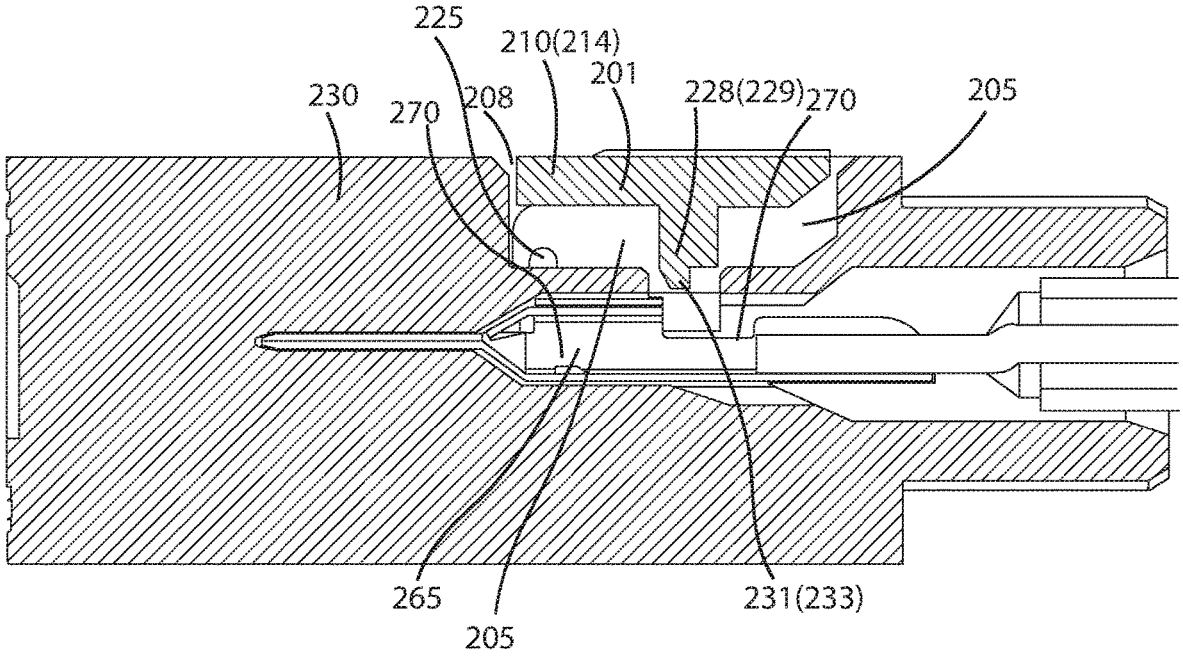
FIG. 19A is a cross-sectional view of a portion of the high voltage connector assembly having the high voltage electrical terminal inserted therein and the male TPA device of this invention within in a pre-lock position.
Figure 20A:
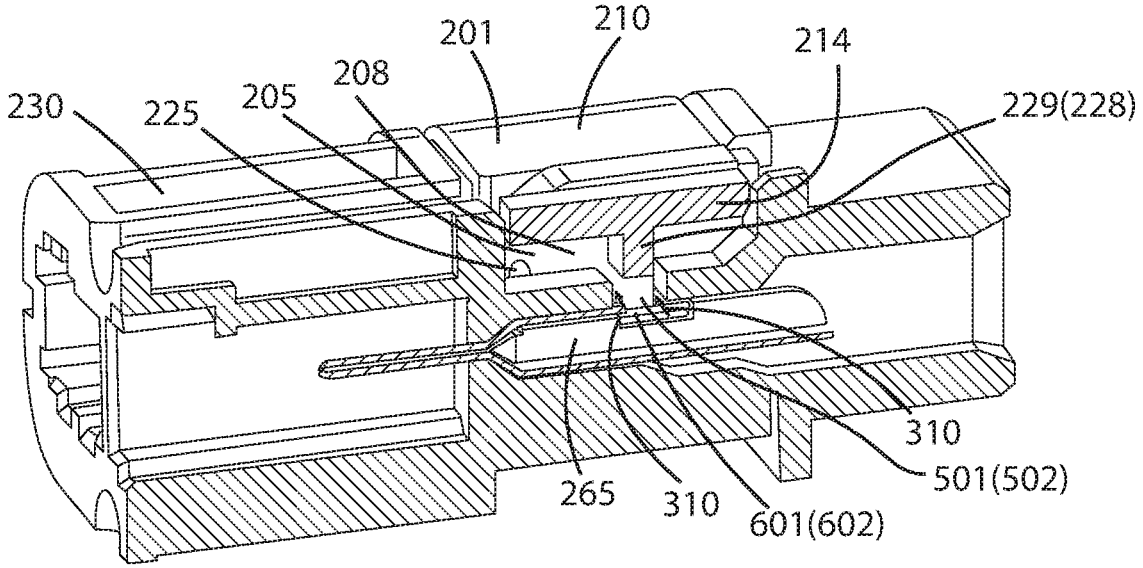
FIG. 20A is a cross-sectional view of a portion of the high voltage connector assembly having the high voltage electrical terminal inserted therein and the male TPA device of this invention within in a pre-lock position and illustrating therein a clearance or creepage for the electrical path substantially along a surface of the male TPA device of this invention.

FIG. 19A, is a cross-section view of the male TPA device 200, clearly showing the terminal 265 residing inside the male inner housing 30 at a pre-lock position. The lower member 205 of the male TPA device 200 is residing in a portion of the middle channel 400 of the male inner housing 230 (see, FIGS. 20A, 21A and 22A). When the male TPA device 201 is at a pre-lock position, the lower member 205 is inserted into and resides in a portion of a middle channel 400. A portion of the elongated slot 225, of lower member 205, is exposed in the opening 208 of the male inner housing 230 and substantially above the first and second channel 501, 502. Further, the pre-lock orientation consequently aligns a first and second channel 501, 502 of the male inner housing 230 beneath a corresponding one of the intermediate members 228, 229 (with a corresponding one of the nubs 231, 233) of the male TPA device 1. The first and second channels 501, 502 thereby may accommodate a corresponding one of the intermediate members 228, 229 and be inserted thereinto (see, FIG. 22B). Further, in a pre-lock position of the male TPA device 1, the intermediate members 228, 229 are residing within a portion thereof of the opening 208, and above and further defining the corresponding upper portions of the first and second channels 501, 502 respectively.

Figure 19B:
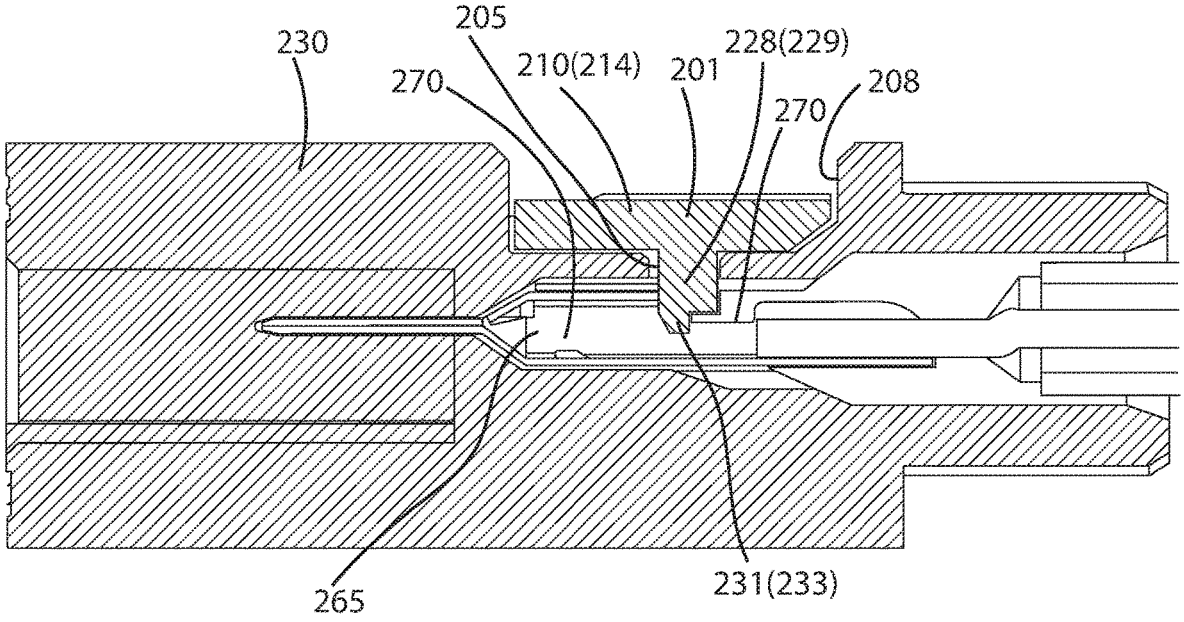
FIG. 19B is a cross-sectional view of a portion of the high voltage connector assembly having the high voltage electrical terminal inserted therein and the male TPA device of this invention within in a full-lock position.

Illustrated in FIG. 19B is the male TPA device 201 at a full-lock position. As shown, and described previously, the male TPA device 201 here further been pushed downward from pre-lock position to full-lock position with the corresponding intermediate members 228, 229 of the male TPA device 201, having been fully inserted or accommodated within the first and second channels 501, 502 and a corresponding slot 270 of the corresponding terminal 265 (also see, FIG. 22A). Consequently, with the male TPA device 1 in a full-lock position inside the male inner housing 230, the terminal 265 cannot be removed from the male inner housing 230 (i.e., the male TPA device 1 acting as a the secondary lock for the terminals 65 inside the male inner housing 30). Here, the male TPA device 1 is at a full-lock position whereby the lower member 205 is inserted further into and resides further into the middle channel 400 of the male inner housing 230, compared to the male TPA device 1 at the pre-lock position. Thus, as shown in FIG. 21B, when the TPA is at full-lock, the elongated slot 225, of lower member 205, is therefore lowered further and resides substantially in the middle channel 400 (see FIG. 22B). An upper portion and smaller portion thereof, of the elongated slot 225 is above and even with the first and second channel 501, 502 when in the male TPA device 1 is at a full-lock position, thereby accommodating the clearance and or creepage path of the electrical path 310, as further discussed below (see, FIG. 21B, 22B).

Figure 22A:
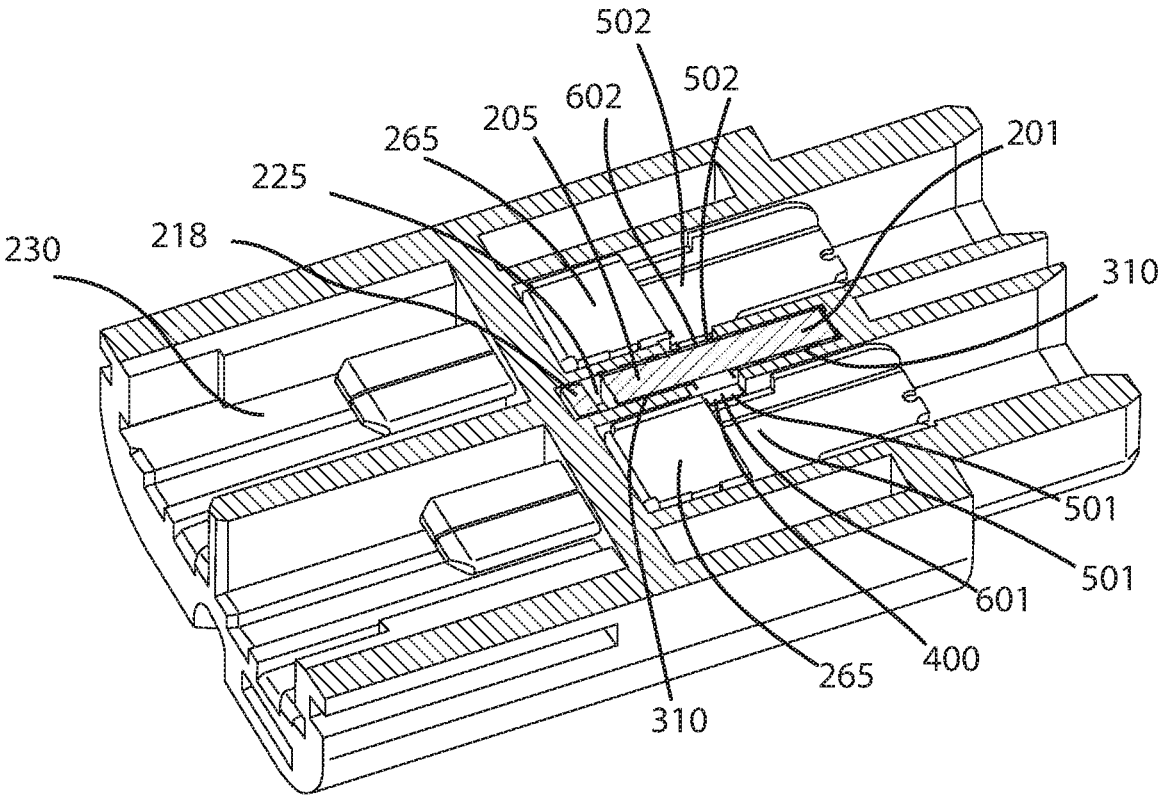
FIG. 22A is a cross-sectional view of a portion of the high voltage connector assembly having the high voltage electrical terminal inserted therein and the male TPA device of this invention within in a pre-lock position and illustrating therein a clearance or creepage for the electrical path substantially along a surface of the male TPA device of this invention.
Figure 22B:
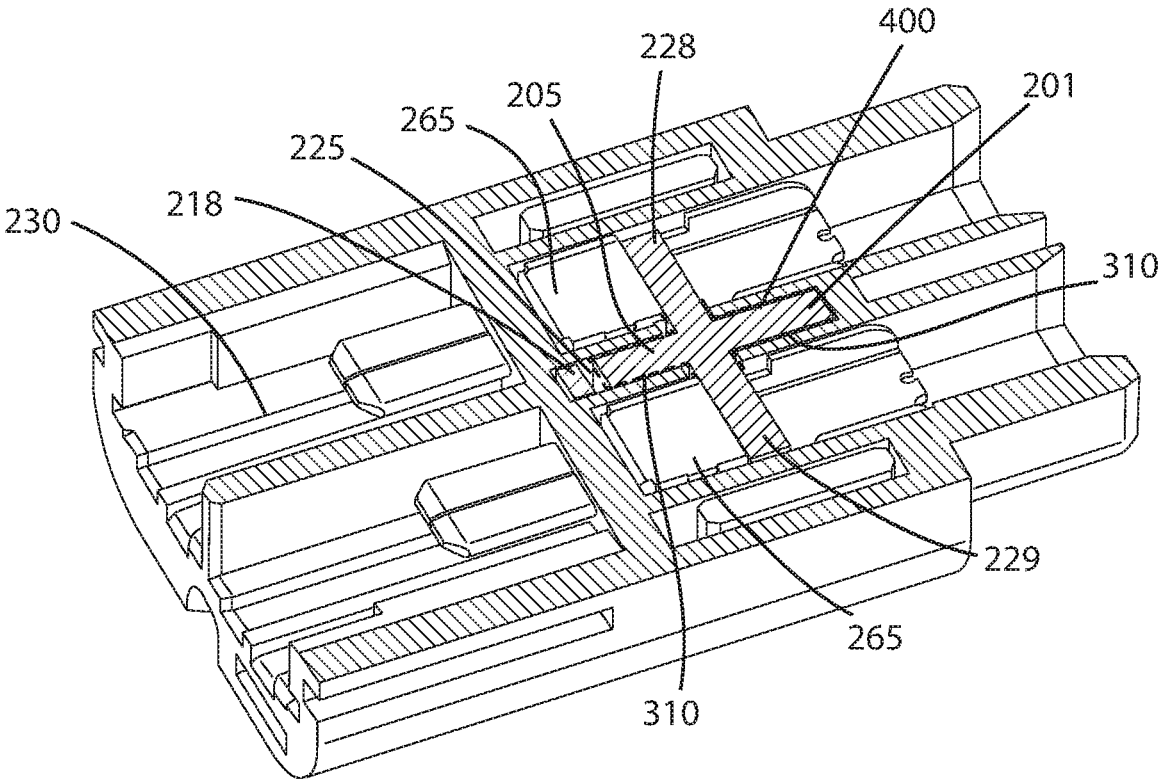
FIG. 22B is a cross-sectional view of a portion of the high voltage connector assembly having the high voltage electrical terminal inserted therein and the male TPA device of this invention within in a full-lock position and illustrating therein a clearance or creepage for the electrical path substantially along a surface of the male TPA device of this invention.
Figure 23A:
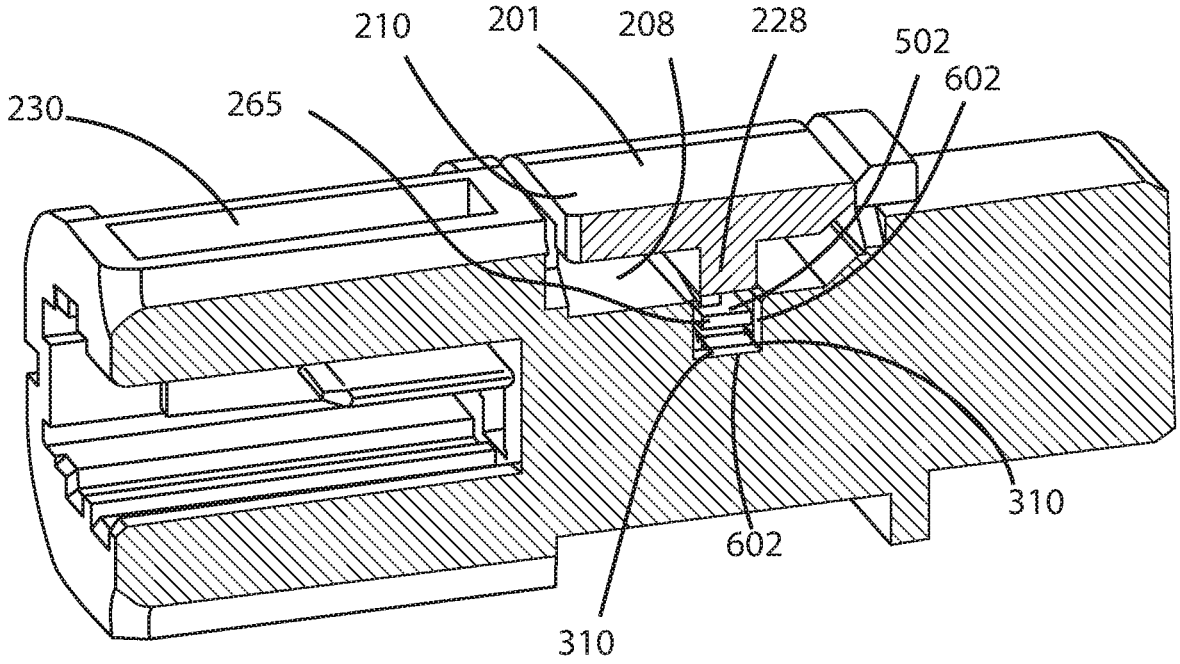
FIG. 23A is a cross-sectional view of a portion of the high voltage connector assembly having the high voltage electrical terminal inserted therein and the male TPA device of this invention within in a pre-lock position and illustrating therein a clearance or creepage for the electrical path substantially along a surface of the male TPA device of this invention.

As seen in more detail in FIGS. 21A and 21B, the lower member 205 acts as a type of "wall" or "barricade" within the male inner housing 230, and is substantially between the high voltage electrical terminals 265, when the male TPA device 201 is in operation and within the male inner housing 230 (also see, FIG. 22A, 22B). When in operation, the lower member 205 further and substantially adds a surface in a lengthwise direction of the male inner housing, and within the middle channel 400 of male inner housing 230 in which the electrical path 310, is substantially directed around as previously discussed (see, FIGS. 18, 19A, 19B). Consequently, the lower member 205, therefore increases creepage, and consequently the clearance of the electrical path 310 (see also, FIGS. 22A, 22B). Comparatively, and as previously described above, if the male inner housing 230 is in operation, absent a lower member 205 and male TPA device 201 of the present invention, the electrical path 310 has a smaller clearance from one high voltage electrical terminal 265 to another high voltage electrical terminal 265, than when the male TPA device 201 resides in a pre-lock or full-lock orientation (see eg. FIG. 18, 22A, 22B), Additionally, and advantageously, the wing-like shape side members 210, 214 prevent the electrical path 310, between the high voltage electrical terminals 265, from traveling or traversing over the top of the male TPA device 201 (see, 13A, 13B). The inner and outer surface of the wing-like shape side members 210, 214, have a surface distance between the high voltage electrical terminals 265, greater than the creepage or clearance surface provided by the surface along the lower member 205 and with male inner housing 230. Thereby, the clearance and creepage of the electrical path 310 extending and along the male TPA device 201 is directed around the lower member 205 (also see, FIGS. 23A, 23B).

As further illustrated in FIG. 22A, the clearance and or creepage for the electrical path 310 from one of the high voltage terminals 265 substantially extends to another one of the high voltage terminals 265. As in FIG. 20A, the electrical path is emitted from one of the high voltage electrical terminals 265 and into a portion of one of the first and second channels 501, 502 respectively. The clearance and or creepage of the electrical path 310 further directs within or extends within the first and second channels 501, 502 respectively, and exits into the middle channel 400 (see FIG. 21A). As in FIG. 21A, the electrical path 310 is exited from the first and second channels 501, 502 respectively, along and through corresponding side surfaces of one of a first and second notches 601, 602 and may also be directed along and through a corresponding portion of the top surface of the one of the first and second notches 601, 602, respectively (see FIG. 20A). As detailed in FIG. 21A, the clearance and or creepage for the electrical path 310 is further directed between and along the surface of a side of the lower member 205 and the inner surface of the middle channel 400. Further, as in FIGS. 21A and 22A, the clearance and or creepage for the electrical path 310 enters into and through a portion the elongated slot 225 at one end of the male TPA device 201. Additionally, at the end opposite the elongate slot 225, the clearance and or creepage for the electrical path 310 passes along and between the opposite end of the lower member 205 of the male TPA device 200 and surface of the middle channel 400 of the male inner housing 230. The clearance and or creepage of the electrical path 310, further passes along and between the opposite surface of a side of the lower member 205 and the inner surface of the middle channel 400 (see, FIG. 22A). The electrical path 310 then enters the opposite one of the first and second channels 501, 502, respectively, and from the middle channel 400 (see FIG. 23A) As seen in detail in FIG, 23A, the electrical path 310 enters the opposite one of the first and second channels 501 502, respectively, substantially passing along corresponding side surfaces of, and may pass along a top portion of, an opposite one of the a first and second notches 601, 602, respectively. Once the electrical path 310 further enters in the opposite one of the first and second channels 501, 502, respectively, the electrical path 310 finally passes directly towards and into another one of the high voltage electrical terminals 265 (see, FIG. 22A, 23A). The above also having the order of the electrical path 310 vice versa between the terminals 265.

Figure 20B:
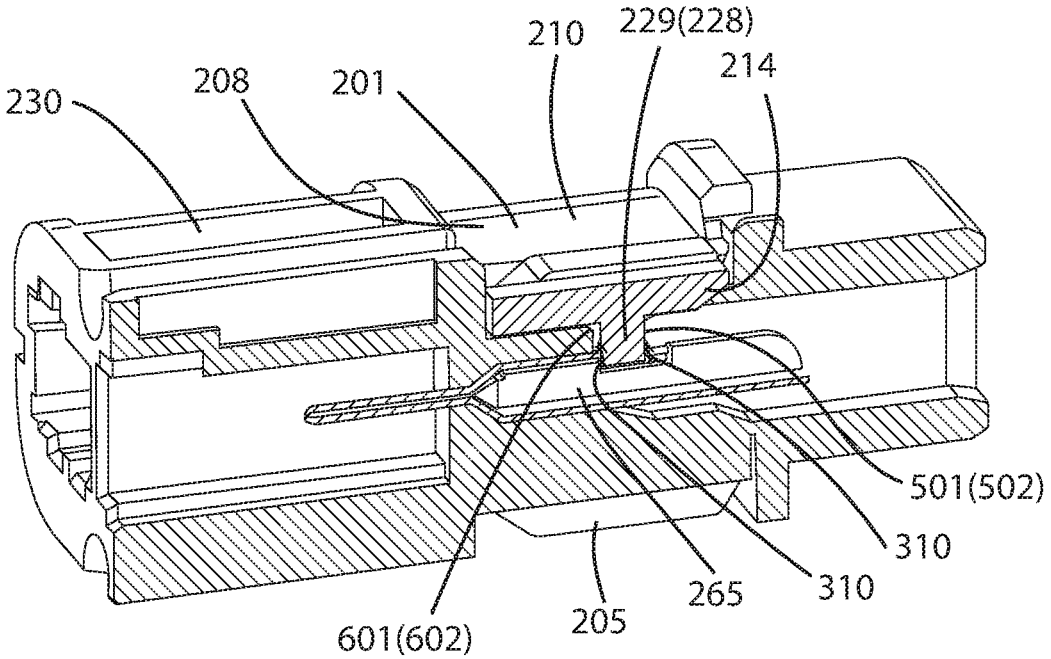
FIG. 20B is a cross-sectional view of a portion of the high voltage connector assembly having the high voltage electrical terminal inserted therein and the male TPA device of this invention within in a full-lock position and illustrating therein a clearance or creepage for the electrical path substantially along a surface of the male TPA device of this invention.
Figure 23B:
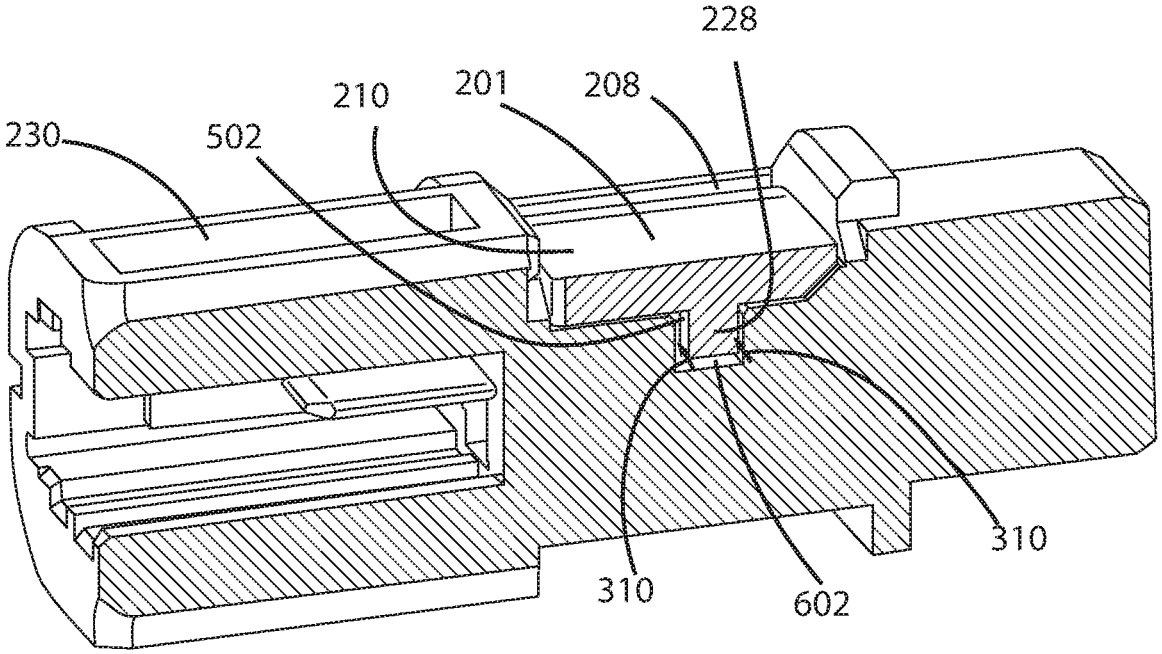
FIG. 23B is a cross-sectional view of a portion of the high voltage connector assembly having the high voltage electrical terminal inserted therein and the male TPA device of this invention within in a full-lock position and illustrating therein a clearance or creepage for the electrical path substantially along a surface of the male TPA device of this invention.

As illustrated in FIGS. 19B and 20B, is a cross-section view of the male TPA device 201 residing in the male inner housing 230 at a full-lock position or orientation therein. Additionally, the lower member 205 of the male TPA device 200 is residing further into a portion of the middle channel 400 of the male inner housing 230 than the pre-lock position, as previously discussed. Further, the intermediate members 228, 229 are residing within a corresponding portion thereof of the first and second channels 501, 502 respectively, as previously discussed. Here, the wing-like shape side members 210, 214 are substantially in and residing within the opening 208, as previously discussed. Here, detailed in FIG. 20B, at a full-lock position, the clearance and or creepage for the electrical path 310 from one of the high voltage terminals 265, substantially extends from one of the high voltage electrical terminals 265 and into a portion of one of the first and second channels 501, 502 respectively (see FIG. 22B). In the full-lock position or orientation, the electrical path 310 is further directed and or extends thereon and along the side surfaces of one of the intermediate members 228, 229, and additionally on the lower surface of the intermediate members 228, 229 (see, FIG. 21B). As also in FIG. 20B, the clearance and or creepage of the electrical path 310 is further directing through and or exits the first and second channels 501, 502 respectively, toward the middle channel 400 (also see FIG. 22B). Here, with the male TPA device 201 at full-lock, the intermediate members 228, 229 reside substantially into the first and second channels 501, 502, respectively, and into the first and second notches 601, 602 (see, FIG. 22B). This orientation thus, forming a substantially small gap between the side surfaces of the intermediate members 228, 229 and the side surfaces of the first and second notches 601, 602, respectively as compared to the pre-lock orientation of male TPA device 201 (see FIG. 20B, 23B). As seen in FIGS. 20B and 23B, the intermediate members 228, 229 substantially contact the top surface of the notches 601, 602 and therebetween at a portion of the top surface of the notches 601, 602 thereof. The substantially small gap formed, thereby further directs the clearance and creepage along and to the lower member 205 at a point substantially meeting and or aligned at the side surfaces of the first and second notches 601, 602, and a lesser or smaller portion of the corresponding top surface of the first and second notches 601, 602, as compared to the pre-lock orientation. Thus, the electrical path 310 continues as directing through and or exiting the one of a first and second channels 501, 502 respectively, and substantially between and along corresponding side surfaces and a small portion of the top surface of the one of a first and second notches 601, 602 thereof, respectively, and the side surfaces of one of the intermediate members 228, 229 (see, FIGS. 22B, 23B). Further, the clearance and or creepage for the electrical path 310 is further directed between and along the surface of a side of the lower member 205 and the inner surface of the middle channel 400 (see FIG. 21B, 22B). As in FIG. 22B, the clearance and or creepage for the electrical path 310 enters into and through a portion the elongated slot 225 at one end of the male TPA device 201. Additionally, at the end opposite the elongate slot 225, the clearance and or creepage for the electrical path 310 passes along and between the opposite end of the lower member 205 of the male TPA device 201 and surface of the middle channel 400 of the male inner housing 230. The clearance and or creepage of the electrical path 310 further passes along and between the opposite surface of a side of the lower member 205 and the inner surface of the middle channel 400 (see FIG. 22B). As seen in FIG. 23B, the clearance and or creepage of the electrical path 310 further passes along and enters the opposite one of the first and second channels 501, 502, respectively, from the middle channel 400. The electrical path 310 enters the opposite one of the first and second channels 501, 502, respectively, substantially between and along the corresponding side surfaces, and a portion of the top surface thereof, of an opposite one of the first and second notches 601, 602, respectively, and the side surfaces of an opposite one of the intermediate members 228, 229, respectively (see, FIGS. 22B, 23B). Further, once the electrical path 310 further enters in the opposite one of the first and second channels 501, 502, respectively, the electrical path 310 finally passes directly towards and into another high voltage electrical terminals 265 (see FIGS. 22B, 23B). The above also having the order of the electrical path 310 vice versa between the terminals 265.

The present invention is not limited to the above-described embodiments; and various modifications in design, structural arrangement or the like may be used without departing from the scope or equivalents of the present invention.

We claim:

1. A method for improving clearance and creepage in a high voltage connector assembly using a male terminal position assurance (TPA) device, comprising steps of:

inserting at least a high voltage electrical terminal inside a male inner housing of said high voltage connector assembly;

locking said terminal inside said male inner housing of said high voltage connector assembly;

providing said high voltage connector assembly with a male outer housing, said male inner housing being accommodated within said male outer housing;

allowing a clearance or electrical path to extend from said at least terminal to said main outer housing; and further allowing said clearance or creepage for said electrical path to extend said electrical path substantially from at least said high voltage electrical terminal across a lower member of said male TPA device, and to another one among high voltage electrical terminals inside said male inner housing of said high voltage connector assembly.

2. The method for improving clearance and creepage in said high voltage connector assembly using said male TPA device in accordance to claim 1, wherein said step of allowing said clearance or electrical path to extend substantially vertically from at least said terminal to said main outer housing.

3. The method for improving clearance and creepage in said high voltage connector assembly using said male TPA device in accordance to claim 1, further comprising a step of inserting said male TPA device through an opening of said male inner housing and locking said male TPA device into said male inner housing, wherein said step of allowing said clearance or electrical path comprises a step of extending said clearance or electrical path from at least said terminal along a surface of said TPA device to said main outer housing.

4. The method for improving clearance and creepage in said high voltage connector assembly using said male TPA device in accordance to claim 1, further comprising a step of inserting said male TPA device through an opening of said male inner housing and locking said male TPA device into said male inner housing, wherein said step of allowing said clearance or electrical path comprises a step of extending said clearance or electrical path from at least said terminal along a surface of at least a substantially wing-like shape side member of said TPA device to said main outer housing.

5. The method for improving clearance and creepage in said high voltage connector assembly using said male terminal position assurance (TPA) device in accordance to claim 1, further comprising a step of inserting said male TPA device through an opening of said male inner housing and locking said male TPA device into said male inner housing, wherein said step of allowing said clearance or electrical path comprises a step of extending said clearance or electrical path from at least said terminal along a surface of at least an intermediate member of said at least said substantially wing-like shape side member of said TPA device and further along said at least said substantially wing-like shape side member of said TPA device to said main outer housing.

6. The method for improving clearance and creepage in said high voltage connector assembly using said female TPA device in said female housing of said high voltage connector assembly in accordance to claim 1, wherein said step of allowing said clearance or creepage for said electrical path includes a step of extending said electrical path substantially vertically from at least said high voltage electrical terminal across a top portion of said female housing, and further extending substantially vertically into said another one of said high voltage electrical terminal.

7. The method for improving clearance and creepage in said high voltage connector assembly using said female TPA device in said female housing of said high voltage connector assembly in accordance to claim 1, wherein said step of inserting said female TPA device into said female housing includes a step of locking said female TPA device to said female housing at a pre-lock position.

8. The method for improving clearance and creepage in said high voltage connector assembly using said female TPA device in said female housing of said high voltage connector assembly in accordance to claim 1, wherein said step of inserting said female TPA device into said female housing includes the step of locking said female TPA device to said female housing at a full-lock position.

9. The method for improving clearance and creepage in said high voltage connector assembly using said female TPA device in said female housing of said high voltage connector assembly in accordance to claim 2, wherein said female TPA device includes extending members respectively extending downwards from frontward extending members, and wherein said female housing includes a front portion.

10. The method for improving clearance and creepage in said high voltage connector assembly using said male TPA device in said male housing of said high voltage connector assembly in accordance to claim 1, wherein said step of inserting said male TPA device into said male housing includes a step of locking said female IPA device to said male housing at a pre-lock position.

11. The method for improving clearance and creepage in said high voltage connector assembly using said male TPA device in said male housing of said high voltage connector assembly in accordance to claim 1, wherein said step of inserting said male TPA device into said male housing includes the step of locking said male TPA device to said male housing at a full-lock position.

12. The method for improving clearance and creepage in said high voltage connector assembly using said male TPA device in said male housing of said high voltage connector assembly in accordance to claim 2, wherein said male TPA device includes a substantially wing-like shape side member respectively extending therefrom.

13. A method for improving clearance and creepage in a high voltage connector assembly using a female terminal position assurance (TPA) device in a female housing of a high voltage connector assembly, comprising the steps of:

inserting at least a high voltage electrical terminal inside said female housing of said high voltage connector assembly;

locking said high voltage electrical terminal inside said female housing of said high voltage connector assembly;

inserting said female TPA device into said female housing; and allowing a clearance or creepage for an electrical path to extend from said at least said high voltage electrical terminal across a lower member of said male IPA device, and to another one of said high voltage electrical terminal.

14. A method for improving clearance and creepage in a high voltage connector assembly using a male terminal position assurance (TPA) device in a male housing of a high voltage connector assembly, comprising the steps of:

inserting at least a high voltage electrical terminal inside said male housing of said high voltage connector assembly;

locking said high voltage electrical terminal inside said male housing of said high voltage connector assembly;

inserting said male TPA device into said male housing; and allowing a clearance or creepage for an electrical path to extend from said at least said high voltage electrical terminal across a lower member of said male TPA device, and to another one of said high voltage electrical terminal.

* * * * *